US005170537A

United States Patent [19]

Sperling

[11] Patent Number: 5,170,537

[45] Date of Patent: Dec. 15, 1992

[54] STRAP OR BAND WITH CATCH

[76] Inventor: Gösta-Christian Sperling, Zum Wald 16, D-W-7750 Konstanz 18, Fed. Rep. of Germany

[21] Appl. No.: 837,749

[22] Filed: Feb. 18, 1992

[30] Foreign Application Priority Data

Feb. 20, 1991 [CH] Switzerland ..... 00522/91
Feb. 6, 1992 [CH] Switzerland ..... 00341/92

[51] Int. Cl.[5] ..... A44B 11/00
[52] U.S. Cl. ..... 24/136 A; 24/115 G
[58] Field of Search ..... 24/136 A, 136 R, 136 K, 24/136 L, 115 G, 115 H, 616, 116 A; 119/106, 117, 121

[56] References Cited

U.S. PATENT DOCUMENTS 649,026 5/1900 Wood ..... 119/106
700,412 5/1902 Fischer ..... 24/136 A
842,935 2/1907 Bulova ..... 24/616
1,606,873 11/1926 Gamache et al. ..... 24/136 A
2,612,139 9/1952 Collins ..... 119/106
3,348,388 10/1967 Elliott ..... 24/115 H
3,994,521 11/1976 Van Gompel ..... 24/136 A
4,020,795 5/1977 Marks ..... 119/106
4,180,016 12/1979 George ..... 119/106
4,366,602 1/1983 Conlon et al. ..... 24/136 A
4,681,356 7/1987 Brammall ..... 24/115 G

FOREIGN PATENT DOCUMENTS 0001880 of 1913 United Kingdom ..... 24/136 A
0276525 9/1927 United Kingdom ..... 24/136 A

*Primary Examiner*—Victor N. Sakran
*Attorney, Agent, or Firm*—Peter K. Kontler

[57] ABSTRACT

A necklace, brace, hoop, strap, choker, bracelet or anklet wherein a flexible component has a free end and a second end carrying a coupling which can releasably engage the free end. When the free end is disengaged from the coupling, the flexible component can serve to support a single pendant, two or more pendants, a string of pearls, other beads, stones and/or analogous decorative objects. The number and/or distribution of the objects can be altered as soon as the free end is disengaged from the coupling. The overall length of the flexible component can be reduced by cutting off a portion at the free end.

19 Claims, 2 Drawing Sheets

STRAP OR BAND WITH CATCH

BACKGROUND OF THE INVENTION

The invention relates to straps, bands, hoops, bangles, sleeves, bracelets, necklaces, anklets, chokers and like decorative and/or utilitarian articles. More particularly, the invention relates to improvements in articles which can be converted from structures of finite length into circumferentially complete (e.g., ring-shaped, hoop-shaped or loop-shaped) bodies. Typical examples of such articles are bracelets, anklets, necklaces and chokers which must be provided with clasps, catches, clips or other types of couplings to permit detachment from the leg, hand or neck of a wearer and rapid and convenient reapplication.

A drawback of presently known articles (e.g., necklaces) of the above outlined character is that, if the flexible component is to carry a string of pearls, other types of beads, stones or like ornamental objects, the clasp normally prevents removal of such objects from the flexible component because it comprises two main (male and female) parts, namely one at each end of the flexible component. Therefore, if the user wishes to remove a damaged object or to replace some or all of the objects with another set of objects, such work is normally carried out by a jeweler with attendant expenditures for charges and loss in time. The situation is further aggravated if the neighboring objects on the flexible component of a necklace are separated from each other by knots; any changes in the distribution and/or in the number of objects necessitate restringing by a specialist who must destroy the component and replace it with a fresh flexible component. It is also known to simply tie the ends of an elongated flexible component of a necklace to each other so that the necklace can be slipped over the head for the purpose of wearing it or for the purpose of moving it off the neck.

On the other hand, there exists an urgent need for a versatile article which can be used as a strap, hoop, bangle, choker, anklet, necklace or bracelet so that the user can alter the number of objects which are strung onto the flexible component and/or that the user can remove all objects and/or that the user can rearrange the distribution of objects which are to be strung onto the flexible component. Furthermore, it is often desirable to employ the flexible component of a necklace, a bracelet or a like article without any beads, pearls, stones or like objects, e.g., for suspension of a pendant, a brooch or any other part which is suitable for a particular occasion.

OBJECTS OF THE INVENTION

An object of the invention is to provide a novel and improved article which can be used as a collar, sleeve, band, strap, bangle, necklace, choker, anklet, bracelet or the like and is more versatile than heretofore known articles of similar character.

Another object of the invention is to provide a convertible article of jewelry, particularly, a necklace, choker, anklet or bracelet.

A further object of the invention is to provide a novel and improved flexible component for use in the above outlined article.

An additional object of the invention is to provide an article which can be rapidly converted to suit a particular purpose or occasion without relying on jewelers or other skilled persons.

Still another object of the invention is to provide a novel and improved combination of a flexible component and a coupling (such as a clasp, a catch or a clip) for use in the above outlined article.

A further object of the invention is to provide a novel and improved coupling for use in the above outlined article.

Another object of the invention is to provide a novel and improved method of increasing or reducing the effective length of a bracelet, strap, choker, bangle, anklet, necklace or an analogous decorative or utilitarian article.

An additional object of the invention is to construct and assemble a necklace or an analogous decorative article in such a way that the beads, pearls or like decorative objects thereof can assume and retain selected positions relative to each other without resorting to knots, distancing elements or like expensive expedients.

Still another object of the invention is to provide a decorative article which can be applied and detached as often as desired and which can be shortened or lengthened in actual use without resorting to any tools, or to any specially designed tools, and with the exercise of a minimal effort.

A further object of the invention is to provide an article which can be mass produced in available machinery.

SUMMARY OF THE INVENTION

The invention is embodied in an article of manufacture (for example, a decorative piece of jewelry, a belt, a strap, a hoop or a sleeve) which comprises an elongated flexible component having a first end portion and a second end portion, and a coupling (e.g., in the form of a clasp, catch, buckle or clip) which is provided solely on the first end portion and is operable to releasably engage the second end portion of the component so that the latter can be said to constitute an endless body resembling a bracelet, a necklace or the like.

The elongated flexible component can have a substantially circular or oval cross-sectional outline and can include or constitute at least one string or cord, e.g., a suitably treated ligament or tendon of an animal body, a woven cord or string, a string or cord made of a plastic material or at least one wire. For example, the component can include or can constitute a single elongated piece of wire or an elongated core consisting of one or more wires and a further wire which forms an elongated envelope for and is convoluted around the core, preferably in such a way that the core cannot be shifted axially of the envelope and/or vice versa.

If the elongated component is used as a carrier of hollow beads, stones or analogous decorative objects, the diameter of the hole in each such object preferably only slightly exceeds the diameter of the component so that an object which has been slipped onto the second end portion of the component (while the second end portion is disengaged from the coupling) can be moved along the intermediate portion of the component and preferably all the way or at least near to the first end portion. To this end, the cross-sectional area of the component is preferably constant, at least to the first end portion. For example, the difference between the diameter of a through hole in a bead, stone or a like object and the diameter of the component can be in the range of between 0.02 and 0.1 mm, and the diameter of the component can be less than 0.9 mm.

The first end portion of the component can be permanently or more or less permanently secured to the coupling, e.g., by welding or soldering, by resorting to a suitable adhesive or in any other suitable way.

In accordance with a presently preferred embodiment of the invention, the coupling comprises a support which is connected with the first end portion of the elongated component, a receptacle (e.g., a sleeve) which is carried by and is movable (e.g., reciprocable) relative to the support between first and second positions and has an inlet for the second end portion of the component, and means for engaging and holding the properly inserted second end portion of the component in one of the two positions of the receptacle relative to the support. Such coupling can further comprise means for yieldably urging the receptacle to the one position.

More specifically, the support of the just outlined coupling can include a tubular first section which is secured to the first end portion of the flexible component and a tubular second section which is connected to (e.g., by being of one piece with) the first section. The two sections of the support define an elongated passage having a first open end in the first section and a second open end in the second section. The receptacle surrounds and is reciprocable along the second section and its inlet is in line with the second end of the passage so that the second end portion of the component can be introduced into, and can even be advanced beyond the first end of, the passage by entering the passage through the inlet of the receptacle and the second end of the passage while the receptacle is maintained in the other position. The means for engaging and holding the second end portion of the component is provided in the receptacle and is designed to engage and retain the second end portion in response to movement of the receptacle from the other to the one position. The clamping means can comprise at least one cam in the receptacle and at least one cam follower which is confined in the receptacle and is movable by the at least one cam toward and into engagement with the second end portion of the component in response to movement of the receptacle from the other position to the one position. For example, the at least one follower can constitute a ball or a wedge. The coupling can comprise a set of at least three balls, and the at least one cam can constitute a conical internal surface of the receptacle and can taper toward the inlet.

The first end portion of the component can be laterally adjacent the first end of the passage so that it does not interfere with advancement of the second end portion of the component through and beyond the passage (in a direction from the first open end toward and beyond the second open end).

The aforementioned urging means can comprise one or more resilient elements (e.g., a coil spring or one or more dished springs) which react against one section of the support and bear against the receptacle to bias the latter to the one position, i.e., to ensure that the cam follower or followers of the clamping means normally engage and retain the second end portion of the flexible component in the receptacle.

The novel features which are considered as characteristic of the invention are set forth in particular in the appended claims. The improved article itself, however, both as to its construction and the mode of using the same, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
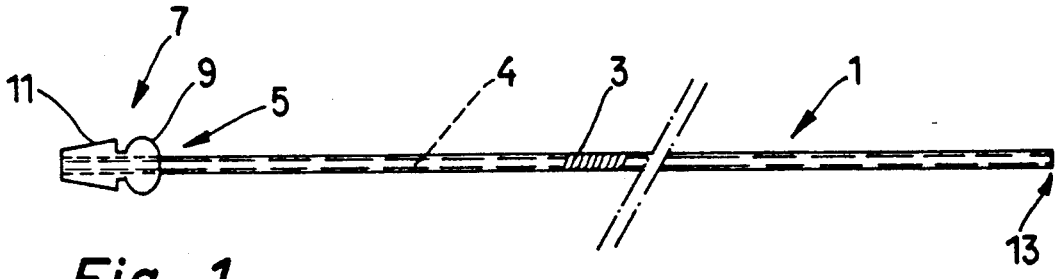
FIG. 1 is an elevational view of an article which embodies one form of the invention and is shown in the form of an open necklace or bracelet with the second end portion of the flexible component detached from the coupling.
Figure 2:
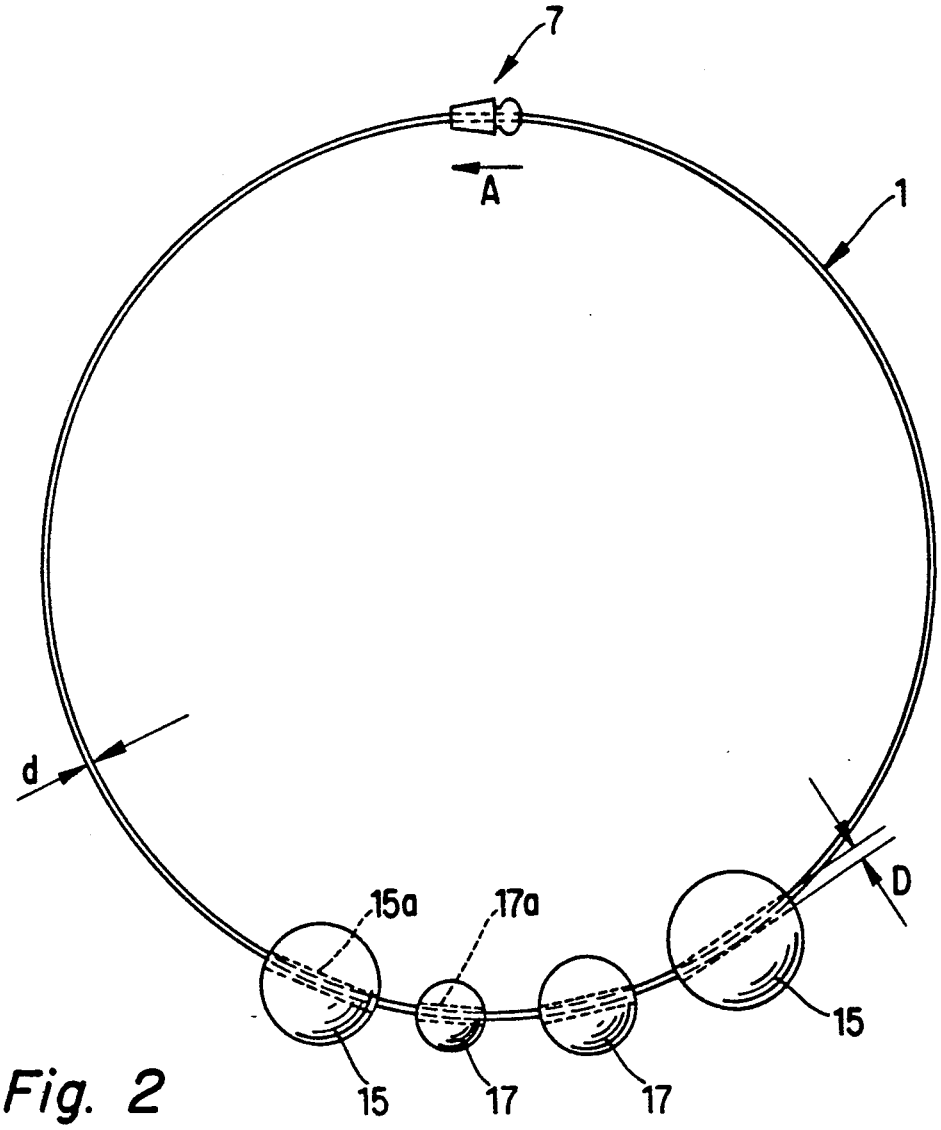
FIG. 2 shows the article of FIG. 1 but with the second end portion of the flexible component connected to the coupling and several hollow bead-like objects strung onto the intermediate portion of the flexible component.

Referring first to FIGS. 1 and 2, there is shown a strap or band which can be used as an anklet, a necklace or a bracelet and comprises two basic parts, namely an elongated flexible component 1 having a first end portion 5 and a second end portion 13, and a coupling or catch 7 which is carried solely by the first end portion 5 and is designed to releasably engage and hold the second end portion 13, e.g., in a manner as shown in FIG. 2 in which the component 1 constitutes a ring-shaped body which can be used as an anklet, a necklace or as a bracelet, depending upon the length of the component 1 and upon the selected locus of connection of the second end portion 13 to the coupling 7. The component 1 has a substantially circular or oval cross-sectional outline and its cross-section is or can be constant all the way from the tip of the end portion 13 to the locus where the coupling 7 is permanently or detachably connected to the first end portion 5. For example, the component 1 can include an elongated core 4 consisting of a single piece of wire or of two or more lengths of wire, and an elongated envelope 3 consisting of one or more additional wires which are convoluted around the core 4. At least the envelope 3 can be made of silver, gold, platinum or another noble metal, the same as the coupling 7.

It is equally possible to make the core 4 and/or the envelope 3 of a cord or string consisting of a plastic or other suitable material (such as a treated animal tendon or ligament).

For example, the component 1 need not be decorative if the article of FIGS. 1 and 2 is to form a necklace, choker or bracelet with hollow beads, stones or other objects (four shown in FIG. 2, as at 15 and 17) strung onto the intermediate portion of the component so that at least the major portion of the component remains concealed when the article is in use.

The end portion 5 of the component 1 can be welded, soldered or glued to or otherwise connected with the coupling 7. Furthermore, and if the component 1 is assembled in a manner as shown in FIGS. 1 and 2, the envelope 3 is preferably maintained in reasonable or pronounced frictional engagement with or is bonded to the core 4 so that the parts 3, 4 of the component 1 cannot slide relative to each other. If the component 1 is readily visible in actual use, i.e., if this component is not surrounded by one, two or more beads or analogous objects, it can be made of hammered or otherwise decorated metallic wire to enhance the appearance of the article when the latter is used as a bracelet, an anklet, a choker or a necklace. Furthermore, the component 1 can be assembled of two or more links or sections, as long as the entire coupling 7 is connected to a single end portion 5 and as long as a hollow object (such as 15 and/or 17) can be slipped onto the other end portion 13 and can be moved, either readily or in response to the exertion of a certain force, to any desired position between the tip of the end portion 13 and the coupling 7. The component 1 can carry a string of identically or differently colored, shaped and/or dimensioned objects. Also, the owner can purchase additional objects which then replace or are used with the objects on the component 1, depending on the momentary trend or fashion or style.

The diameter of the component 1 is shown at d, and the diameter of the hole or bore 15*a* or 17*a* in an object 15 or 17 is shown at D. The difference between these diameters can be small or very small, preferably between 0.02 and 0.1 if the diameter D equals or approximates 0.9 mm, and the diameter of the component 1 can be less than 0.9 mm. Such dimensioning has been found to be quite satisfactory to ensure that, due to tendency of the component 1 to assume a circular shape and due to the fact that the illustrated holes or bores 15*a*, 17*a* are straight or substantially straight, friction between the external surface of the envelope 3 and the surfaces bounding the holes or bores 15*a*, 17*a* suffices to ensure that the objects 15, 17 will remain in selected positions by friction, i.e., that they need not be separated from each other by knots, relatively small beads or like distancing elements and/or by a combination of both. This greatly enhances the versatility of the article because the component 1 can be used with the coupling 7 to constitute a necklace, an anklet, a bracelet, a choker or an analogous article of jewelry but the owner is in a position to use such rudimentary piece of jewelry with one or more pendants, wooden, plastic or semiprecious beads, stones, pearls or analogous objects. Thus, the improved article exhibits a pronounced versatility which is attributable to the feature that the coupling 7 is connected only to the end portion 5 as well as to the feature that the cross-sectional area of the major part of or the entire component 1 is at least substantially constant.

The coupling 7 is preferably designed in such a way that it comprises a support 9 which is permanently or separably affixed to the end portion 5 of the component 1, and a mobile (preferably reciprocable) receptacle 11 which is mounted on the support 9 for movement between first and second end positions. The end portion 13 can be affixed to (preferably inserted into) the receptacle 11 when the latter assumes one of its two end positions, and the receptacle is thereupon caused or permitted to move to the other end position in which it reliably holds the second end portion 13. As will be described with reference to FIG. 3, the coupling 7 can further comprise means for yieldably urging the receptacle to the other end position to thus ensure that, once the end portion 13 is inserted into the receptacle 11 and the latter is permitted to assume its other end position, the end portion 13 remains reliably affixed to the coupling 7.

Figure 3:
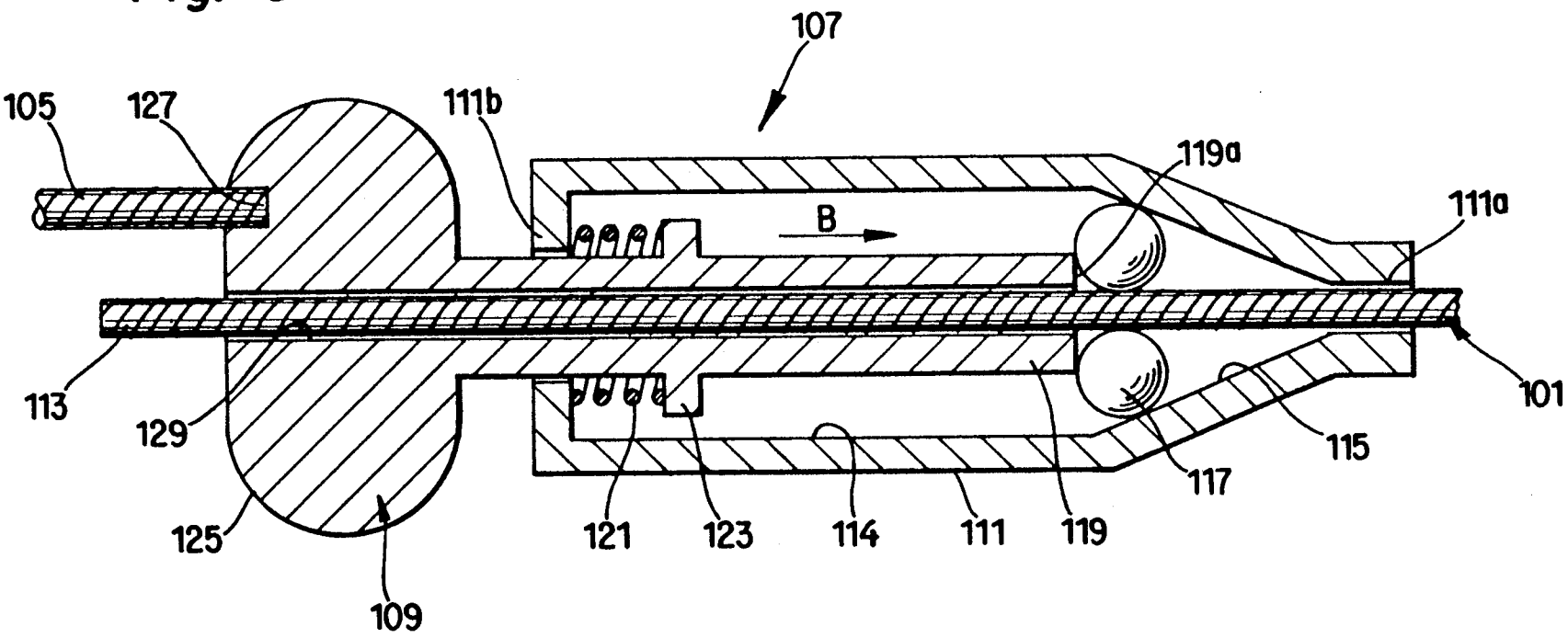
FIG. 3 is a greatly enlarged axial sectional view of one presently preferred coupling.

The coupling 107 which is shown in FIG. 3 comprises a support 109, a sleeve-like receptacle 111 which reciprocably surrounds an elongated tubular section 119 of the support 109, a clamping unit including two or more cam followers 117 and a cam 115, and a coil spring 121 which serves to yieldably urge the receptacle 111 to the end position of FIG. 3. The receptacle 111 has an inlet 111*a* for introduction of the end portion 113 of the elongated flexible component 101, and such inlet is in line with the adjacent open end of an elongated passage 129 which is provided in the support 109 and has a second open end in an enlarged tubular section 125 of the support. The spring 121 reacts against an external collar 123 of the section 119 and bears against the adjacent end wall 111*b* of the receptacle 111 to urge the latter in a direction to the left, as viewed in FIG. 3. This causes the conical internal cam 115 of the receptacle 111 to bear against the spherical followers 117 and to urge these followers against the end face 119*a* of the section 119 and hence into pronounced engagement with the adjacent end portion 113 (or with an intermediate portion) of the component 101, depending upon the extent of penetration of the end portion 113 into or beyond the passage 129. The followers 117 (which can be replaced by wedges or by other suitable clamping elements) are confined in the chamber 114 of the receptacle 111, the same as the major portion of or the entire section 119, the collar 123, the spring 121 and the cam 115. The latter tapers toward the inlet 111*a*. The spring 121 can be replaced by one or more other suitable resilient elements, e.g., by a package of dished springs, as long as the selected urging means is capable of biasing the receptacle 111 to a position in which the followers 117 reliably engage the end portion 113 or an intermediate portion of the component 101 to prevent accidental extraction of the end portion 113 from the passage 129 and from the receptacle.

The end portion 105 of the component 101 is received in a recess 127 or socket (e.g., a blind hole or bore) which is provided in the section 125 laterally of the corresponding open end of the passage 129. This ensures that the end portion 105 does not interfere with advancement of the end portion 113 through and beyond the passage 129. The end portion 105 can be fixedly held in the recess 127 by being welded, soldered or adhesively secured to the section 125. Purely mechanical means (e.g., one or more pins or screws can be utilized with equal or similar advantage to ensure that the end portion 105 does not become accidentally detached from the support 109.

If the user wishes to extract the end portion 113 from the passage 129 and thereupon from the receptacle 111 (by way of the inlet 111*a*), the receptacle is pushed in the direction of arrow B to stress the spring 121 by moving its wall 111*b* away from the section 125. This reduces the force with which the followers 117 bear upon the component 101 so that the end portion 113 can be readily extracted from the coupling 107.

If the end portion 113 is to be reinserted into the coupling 107, the receptacle 111 is again pushed in the direction of arrow B so that the end portion 113 can be readily introduced through and beyond the inlet 111*a* and into the adjacent open end of the passage 129. The person in charge releases the receptacle 111, so that the spring 121 can dissipate energy and causes the cam 115 to move the followers 117 into requisite engagement with the component 101 when the tip of the end portion 113 has been advanced to a desired position, i.e., when the length of the component 101 between the recess 127 and the inlet 111*a* reaches a desired value.

The illustrated coupling 107 can be replaced with other types of couplings without departing from the spirit of the invention, as long as the selected coupling can be mounted solely on the end portion 5 or 105 of the component 1 or 101 and can releasably engage and reliably clamp or otherwise hold the other end portion 13 or 113. For example, certain types of tiepins can be utilized with advantage in lieu of the illustrated coupling 7 or 107. Furthermore, the followers 117 can be replaced by jaws which can be moved radially inwardly by the cam 115 when the spring 121 is free to dissipate energy so that the jaws engage and clamp the adjacent portion of the component 101. The jaws can exhibit the tendency to move apart so that the adjacent portion of the component 101 is released and can be extracted from the coupling as soon as the receptacle (or an equivalent thereof) is shifted relative to the support in order to provide room for radially outward movement of the jaws. All such modifications will be readily appreciated and understood by persons possessing the requisite skill in the art without additional illustrations. The clamping action of the spherical followers 117 or of their equivalents is enhanced in response to exertion of a pull upon the end portion 105 and upon the component portion outwardly adjacent the inlet 111*a* (note the arrow A in FIG. 2), i.e., the clamping or retaining action of the coupling improves if one desires to extract the end portion 113 from the passage 129 and receptacle 111 without prior shifting of the receptacle 111 in the direction of arrow B, i.e., against the opposition of the spring 121.

The owner has an additional option of altering the length of the component 1 or 101, e.g., by simply cutting off a selected length at the end portion 13 or 113. Such option can be resorted to especially if the component 1 or 101 is not made of an expensive material, e.g., if the component is made of a length of cord, string or inexpensive wire.

The improved article can be used with equal or similar advantage as a belt wherein the coupling performs the function of a buckle, as a strap, as a hoop, as a bangle or as any other article wherein the coupling is provided solely at one end of a normally flexible or at least slightly flexible elongated component.

The improved article exhibits a number of important advantages. Thus, the owner can conform the article to the garment which is selected for a particular occasion by removing one or more or all decorative objects from the component 1 or 101, by adding one or more decorative objects to the previously applied or used objects, by changing the number and/or distribution of decorative objects, by changing the effective length of the component and/or by replacing bead-shaped or like decorative objects with one or more pendants, brooches or the like. Furthermore, the user can replace a string of decorative objects of a first color with a string of decorative objects of a different color. Differently colored decorative objects can be grouped at will, the same as differently shaped and/or differently dimensioned objects. All such operations can be carried out without resorting to any tools or by resorting to a rudimentary and readily available tool.

Another advantage of the improved article is that insertion of the end portion 13 or 113 into or its extraction from the coupling 7 or 107 is a simple operation which takes up a minimal amount of time. Furthermore, by resorting to simple scissors or pliers, the owner can change the length of the component 1 or 101 to suit her or his purposes.

A further advantage of the improved article is that, if beads or analogous decorative objects are used, they must be formed with relatively small bores or holes because the holes or bores need not be dimensioned to permit passage of knots, distancing elements or like bulky parts. This renders it possible to employ small or extremely small decorative objects which often enhance the appearance of the article.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. An article of manufacture comprising an elongated flexible component having a first end portion and a second end portion; and a coupling provided solely on said first end portion and operable to releasably engage said second end portion, said coupling comprising a support including a tubular first section secured to said first end portion and a tubular second section connected with said first section, said sections defining a passage for said second end portion and said passage having a first open end in said first section and a second open end in said second section, said coupling further comprising a receptacle surrounding and being reciprocable relative to said second section between first and second positions and having an inlet for said second end portion in line with the second end of said passage so that the second end portion can be introduced into, and can be advanced beyond the first end of, said passage through said inlet in one of said positions of said receptacle, said coupling further comprising clamping means provided in said receptacle to engage said second end portion in response to movement of said receptacle to the other of said positions.

2. The article of claim 1, wherein said component has a substantially circular or oval cross-sectional outline.

3. The article of claim 1, wherein said receptacle includes a sleeve which is reciprocable between said first and second positions.

4. The article of claim 1, wherein said coupling further comprises means for yieldably urging said receptacle to said one position.

5. The article of claim 1, wherein said component includes at least one wire.

6. The article of claim 1, wherein said component comprises an elongated core and an elongated envelope surrounding said core.

7. The article of claim 6, wherein said envelope includes at least one wire which is convoluted around said core.

8. The article of claim 6, wherein said core is affixed to said envelope.

9. The article of claim 1, wherein said component includes a cord.

10. The article of claim 1, wherein said component has a substantially circular cross-sectional outline and a first diameter, and further comprising at least one hollow object on said component, said object having a through hole with a second diameter slightly larger than said first diameter.

11. The article of claim 10, wherein the difference between said diameters is in the range of between 0.02 and 0.1 mm.

12. The article of claim 1, wherein said component has a substantially circular cross-sectional outline with a diameter less than 0.9 mm.

13. The article of claim 1, further comprising means for permanently securing said coupling to said first end portion.

14. The article of claim 1, wherein said clamping means includes at least one cam in said receptacle and at least one cam follower provided in said receptacle and movable by said at least one cam into engagement with the second end portion of said component in response to movement of said receptacle from said one to said other position.

15. The article of claim 14, wherein said at least one follower is ball or a wedge.

16. The article of claim 14, wherein said first end portion is laterally adjacent said first end of said passage.

17. The article of claim 14, further comprising at least one resilient element reacting against one of said sections and bearing against said receptacle to bias said receptacle to said other position.

18. The article of claim 1, wherein said component forms part of or constitutes a decorative piece of jewelry or the like, such as a bracelet or a necklace.

19. The article of claim 1, wherein said component has an at least substantially constant cross-sectional area so that a hollow object which can be slipped onto said second end portion can be advanced along said component all the way or at least close to said coupling.

* * * * *